US007376985B2

(12) United States Patent
Wen

(10) Patent No.: US 7,376,985 B2
(45) Date of Patent: May 27, 2008

(54) MOVING SIPHON PIPE DRIVING DEVICE IN A FLUSHING POT

(76) Inventor: Jong-Chil Wen, 235, Seoksum-ri, Geumho-eup, Yeongcheon-city, Gyeongsangbuk-do, 770-805 (KR)

( * ) Notice: Subject to any disclaimer, the term of this patent is extended or adjusted under 35 U.S.C. 154(b) by 0 days.

(21) Appl. No.: 11/583,165

(22) Filed: Oct. 19, 2006

(65) Prior Publication Data

US 2007/0094783 A1 May 3, 2007

(51) Int. Cl.
*E03D 11/00* (2006.01)

(52) U.S. Cl. ..... 4/421; 4/420; 4/424; 4/DIG. 13; 4/DIG. 16

(58) Field of Classification Search ..... 4/420, 4/421, 24, 434, 368, DIG. 13, DIG. 16, 372, 4/377

See application file for complete search history.

(56) References Cited

FOREIGN PATENT DOCUMENTS

| | | | |
|---|---|---|---|
| JP | 52042637 A | * | 4/1977 |
| KR | 20-0191298 | | 5/2000 |
| KR | 10-0354527 | | 9/2002 |
| KR | 10-0425419 | | 3/2004 |

* cited by examiner

*Primary Examiner*—Khoa D Huynh
(74) *Attorney, Agent, or Firm*—Seyfarth Shaw LLP

(57) ABSTRACT

The present invention relates to a toilet. More particularly, the present invention is directed to an apparatus for operating a variable siphon tube of a toilet, wherein operating reliability of the variable siphon tube can be primarily improved as well as a deodorizing structure can be provided and a rear part of the toilet can also be slimmed.

3 Claims, 7 Drawing Sheets

MOVING SIPHON PIPE DRIVING DEVICE IN A FLUSHING POT

The present invention claims the benefit of international patent application number PCT/KR2004/000937 filed in Korea on Apr. 23, 2004 and Korean patent application no. 10-2004-0027121 filed on Apr. 20, 2004, which are both hereby incorporated by reference in their entirety.

TECHNICAL FIELD

The present invention relates to a toilet. More particularly, the present invention is directed to an apparatus for operating a siphon tube of a toilet, wherein operating reliability of the variable siphon tube can be primarily improved as well as a deodorizing structure can be provided and a rear part of the toilet can also be slimmed.

BACKGROUND ART

The general configuration of an apparatus for operating a variable siphon tube of a toilet is shown in FIGS. 1 and 2. As shown in these figures, the apparatus for operating the variable siphon tube apparatus comprises a variable siphon tube 10 of which both ends are connected to a bowl 1 and a soil pipe 2 via a flexible tube 3, respectively; an upper bellows tube 20 that communicates with a water supply passage 1*a* of the bowl 1 and also communicates with the variable siphon tube 10 via an auxiliary tube 4; a guide bar 30 of which a lower end is fixed onto an installation bottom surface B and an upper end is installed to penetrate through a bottom plate 21 of the upper bellows tube 20; a transverse bar (not shown) which is connected to a middle point of the guide bar and connected to the bottom plate 21 by means of a connection bar; a roller 40 which is installed to be freely rotatable outside of the transverse bar and seated on a bend 11 of the variable siphon tube 10; and a return spring 50 which is installed below the transverse bar to perform a function of restoring the transverse bar to its original state.

However, a toilet with such a conventional variable siphon tube has the following problems.

First, a return spring may be tangled when it is operated.

That is, while the return spring is compressed, spring coils are tangled with one another and thus the spring is not smoothly restored. Therefore, an operating error occurs in that the variable siphon tube 10 may not be restored to its original state even after water in the upper bellows tube 20 is fully discharged.

Second, due to friction between the return spring 50 and the guide bar 30, the operating reliability of the toilet is reduced and noise is produced from the toilet.

That is, while the friction occurs between the return spring and the guide bar 30 passing through the center of the return spring, friction noise and wear on the guide bar are produced. Further, the compressing and restoring operation of the return spring is not smooth. Therefore, there is a problem in that the raising operation of the variable siphon tube 10 is not constant and regular.

Third, it is difficult to install the guide bar 30 on the installation bottom surface B. That is, since the bottom surface is constructed from brittle tiles, there is another problem in that the tiles are easily broken when the guide bar is installed on the tiles. Therefore, there is a difficulty in installing the guide bar on the tiles.

Fourth, since the auxiliary tube 4 is positioned above a highest water level of the variable siphon tube 10, an offensive odor generated from a toilet waste storage tank T is discharged to the outside of the toilet through the variable siphon tube, the auxiliary tube, the upper bellows tube, the water supply passage and the bowl. Therefore, it is difficult to isolate the discharged odor.

Further, since an inlet end of the auxiliary tube 4 is positioned on the flank of the upper bellows tube 20, the remaining water that was not discharged through the auxiliary tube may remain in the bottom floor of the upper bellows tube when the upper bellows tube 20 was restored. Therefore, there is a problem in that the amount of water stored in the bowl 1 is decreased in proportion to the amount of water remaining in the upper bellows tube.

Fifth, when the rear portion of the bowl 1 is brought into close contact with an installation wall surface W as shown in FIG. 2, it should have a sufficient length such that the bend 11 of the variable siphon tube 10 does not interfere with the installation wall surface W during its circular motion. Consequently, since the length of the bowl in a fore-and-aft direction should be further lengthened by a length $\Delta l$, it is difficult to make the toilet slim.

Sixth, there is strong likelihood that the toilet wastes may adhere to the bellows tubes 3 connected to the inlet and outlet of the variable siphon tube 10.

That is, since the bellows tube 3 is formed with several folds on an inner surface thereof, the wastes may adhere and stick to the folds of the bellows tube during their discharge. Therefore, the smooth operation of the bellows tubes is hindered, and thus, the expansion and contraction of the bellows tube are adversely influenced.

EXPLANATION OF REFERENCE NUMERALS FOR MAJOR PORTIONS SHOWN IN DRAWINGS

Figure 1:
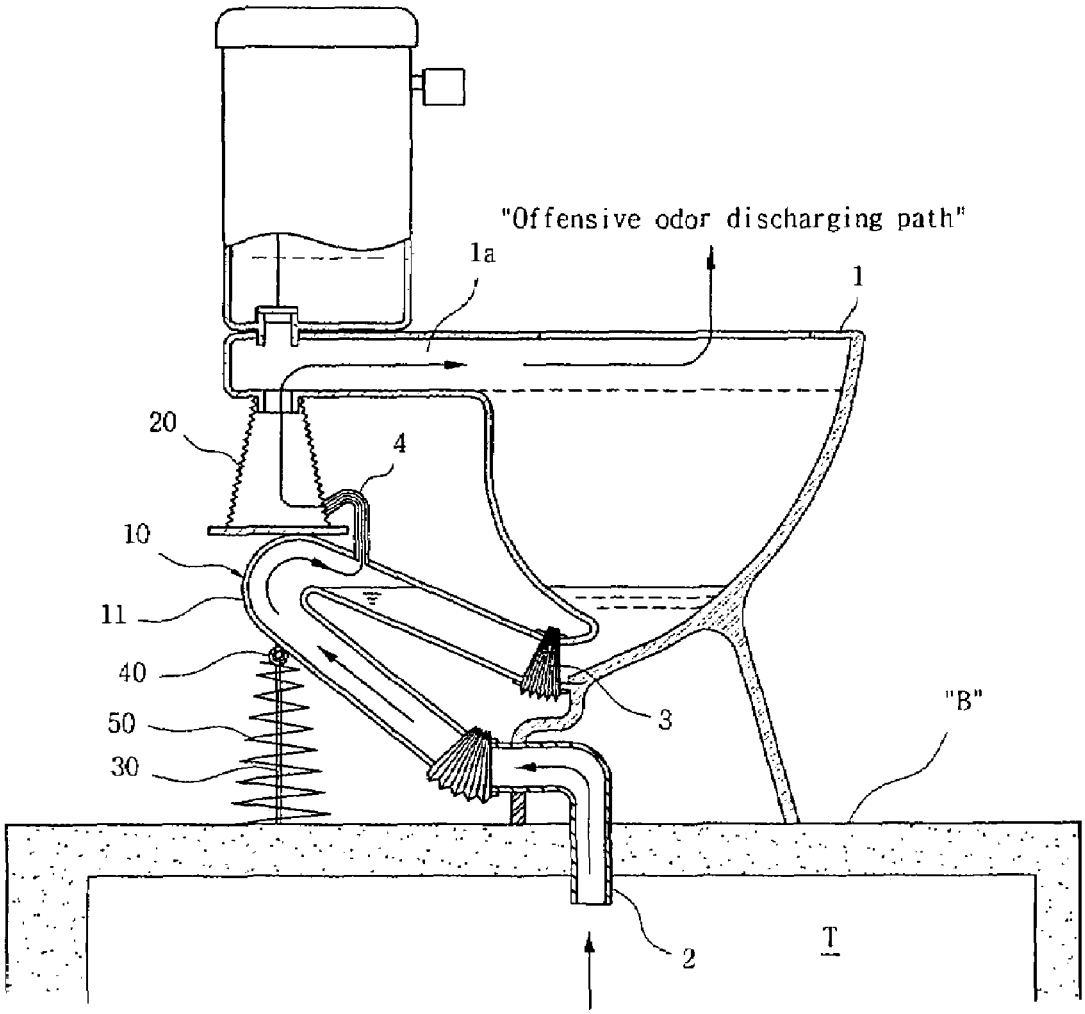
FIG.1 (Prior Art)
FIG. 1 is a sectional view of an apparatus for operating a related art variable siphon tube before it is operated.
Figure 2:
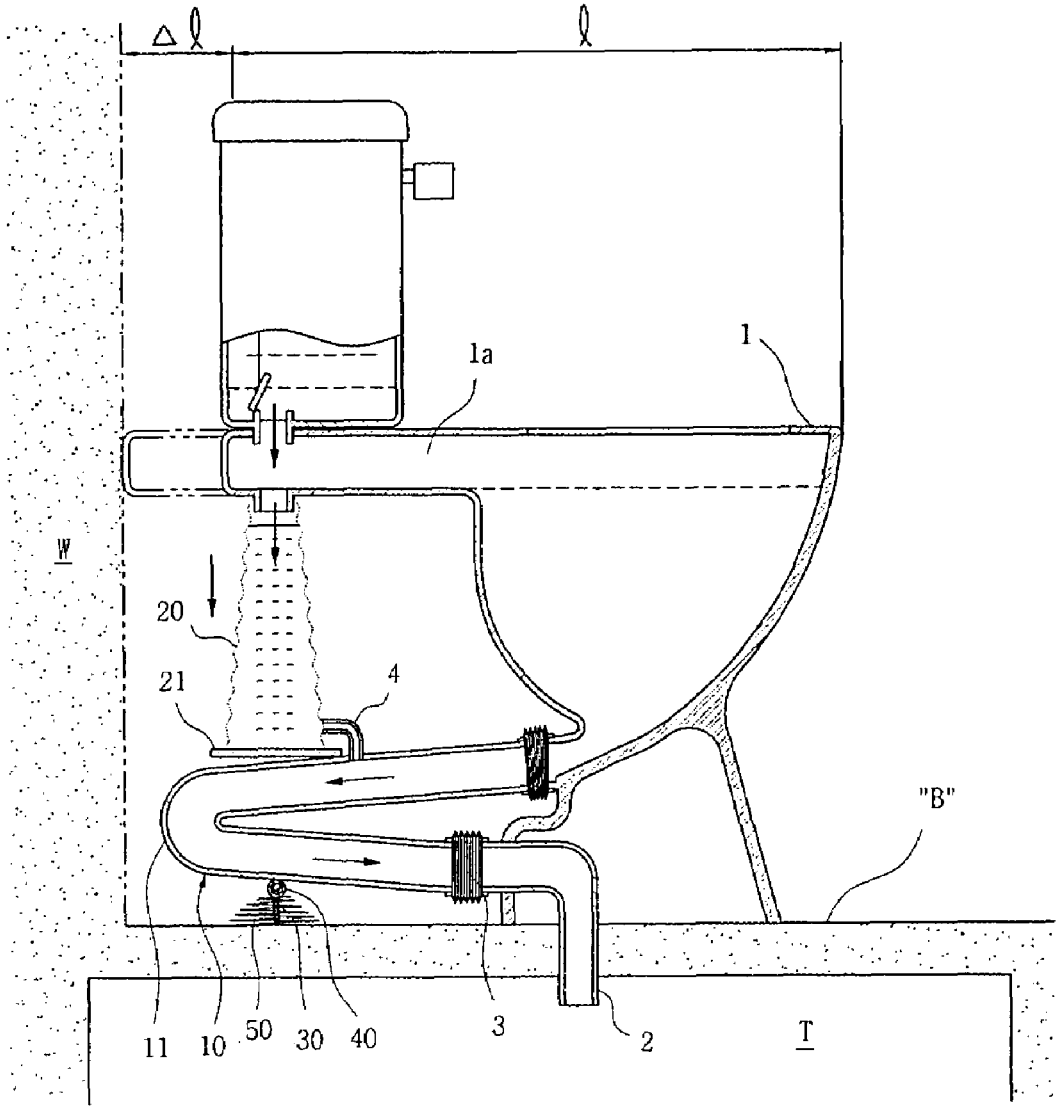
FIG.2 (Prior Art)
FIG. 2 is a sectional view of the apparatus for operating a related art variable siphon tube after it is operated.

110: Pressing tube
120: Tightening belt
130: Bracket
140: Return spring
150: Variable siphon tube
170: Connection tube

DISCLOSURE

Technical Problem

A main object of the present invention is to provide an apparatus for operating a variable siphon tube of a toilet wherein a return spring can be smoothly stretched and compressed by changing its installation position, and thus, the reliability in lifting or lowering the variable siphon tube can be improved.

Another object of the present invention is to provide an apparatus for operating a variable siphon tube of a toilet wherein a deodorizing mechanism is provided for isolating an offensive odor generated from a toilet waste storage tank.

A further object of the present invention is to provide an apparatus for operating a variable siphon tube of a toilet wherein the toilet can be brought into close contact with an installation wall surface without increasing a fore-and-aft length of the toilet by minimizing a rotating path of a bend of the variable siphon tube.

A still further object of the present invention is to provide an apparatus for operating a variable siphon tube of a toilet wherein toilet wastes can be prevented from adhering and sticking onto an inner surface of a bellows tube by installing a vinyl tube in the bellows tube.

Technical Solution

According to an aspect of the present invention, there is provided an apparatus for operating a variable siphon tube for use in a gravity tank toilet including a toilet bowl and a water tank, comprising a pressing tube in the form of a bellows tube that is installed at a rear side of the bowl to communicate with a water supply passage, a tightening ring which allows the top of the pressing tube to be tightly coupled with a connection neck of the water supply tube and includes first hooks formed at both sides thereof, a bracket which is coupled with a bottom surface of the pressing tube and includes second hooks formed at both sides thereof and fitting holes formed at a lower end of each hook, a return spring which is connected to the first and second hooks, a variable siphon tube which includes an inlet and outlet formed at one side thereof and a bend formed at the other side thereof, and a connection tube for connecting the pressing tube and the variable siphon tube, wherein the inlet is connected with a discharge port of the bowl through a bellows tube, the outlet is connected with a toilet waste discharge tube through a bellows tube, the bend is formed with hinge shafts at both lateral sides thereof, and the hinge shafts is fitted into the fitting holes, respectively.

According to another aspect of the present invention, there is provided an apparatus for operating a variable siphon tube for use in a flush valve operated toilet for supplying water directly into a water supply tube of a toilet bowl, comprising a pressing tube in the form of a bellows tube that is installed at a rear side of the bowl to communicate with the water supply passage, a tightening ring which allows the top of the pressing tube to be tightly coupled with a connection neck of the water supply tube, said tightening ring including first hooks formed at both sides thereof, a bracket which is coupled with a bottom surface of the pressing tube and includes second hooks formed at both sides thereof and fitting holes formed at a lower end of each hook, a return spring which is connected to the first and second hooks, a variable siphon tube which includes an inlet and outlet formed at one side thereof and a bend formed at the other side thereof, and a connection tube for connecting the pressing tube and the variable siphon tube, wherein the inlet is connected with a discharge port of the bowl through a bellows tube, the outlet is connected with a toilet waste discharge tube through a bellows tube, the bend is formed with hinge shafts at both lateral sides thereof, and the hinge shafts is fitted into the fitting holes, respectively.

At this time, an inlet end of the connection tube may be connected to communicate with a bottom portion of the pressing tube and an outlet end of the connection tube may be positioned below a highest water level in the variable siphon tube before use.

Further, a vinyl tube may be installed within each of the flexible tubes.

Advantageous Effects

Since an apparatus for operating a variable siphon tube according to the present invention provides only a pulling force produced by a return spring, the return spring is not tangled. Thus, malfunction of the apparatus is not produced. Further, since a guide bar for the return spring is not needed, friction loss or noise generated between the return spring and the guide bar is not produced. Furthermore, since flooring work for installing the guide bar is also not required. Thus, the construction for installing a flush toilet can be easily performed. Moreover, since there is no wear due to the friction, the reliability of operating the apparatus can also be improved.

In addition, since an upper portion of a connection tube is connected to the bottom of the pressing tube, there is no water remaining in the pressing tube. Thus, the operation of the variable siphon tube can be smoothly performed. Further, since a bottom portion of the connection tube is positioned below a highest water level in the variable siphon tube, the water staying in the variable siphon tube allows an offensive odor to rise from a toilet waste storage tank toward a toilet bowl.

Since toilet wastes can be prevented from adhering and sticking to an inner wall of the bellows tube by installing a vinyl tube within a bellows tube connected to inlet and outlet of the variable siphon tube, deterioration of the stretching and compressing operation of the bellows tube can be avoided.

Furthermore, since a bend of the variable siphon tube can be substantially linearly moved by changing a position of a hinge shaft of the variable siphon tube and maximizing the length of the bellows tube connected to a toilet waste discharge tube, the toilet bowl can be brought into close contact with an installation wall surface without increasing a length of the bowl in a fore-and-aft direction. Therefore, there is an advantage in that a space needed for installing the toilet bowl can be reduced to the utmost.

Best Mode

A preferred embodiment of the present invention will be described in detail with reference to FIGS. 3 to 7.

Figure 3:
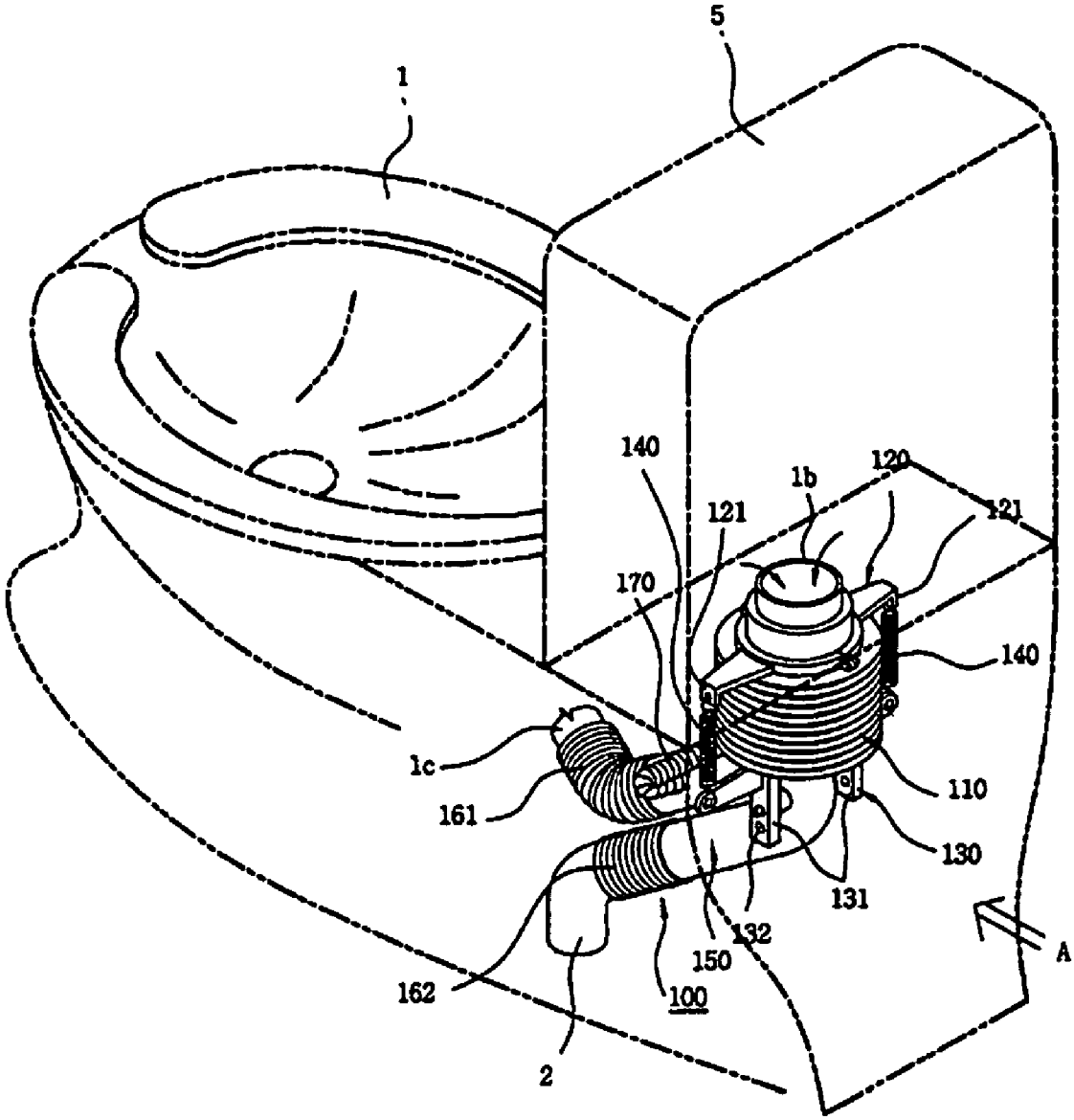
FIG. 3 is a view showing a state where the apparatus for operating the variable siphon tube according to the present invention is installed to a gravity tank toilet.
Figure 4:
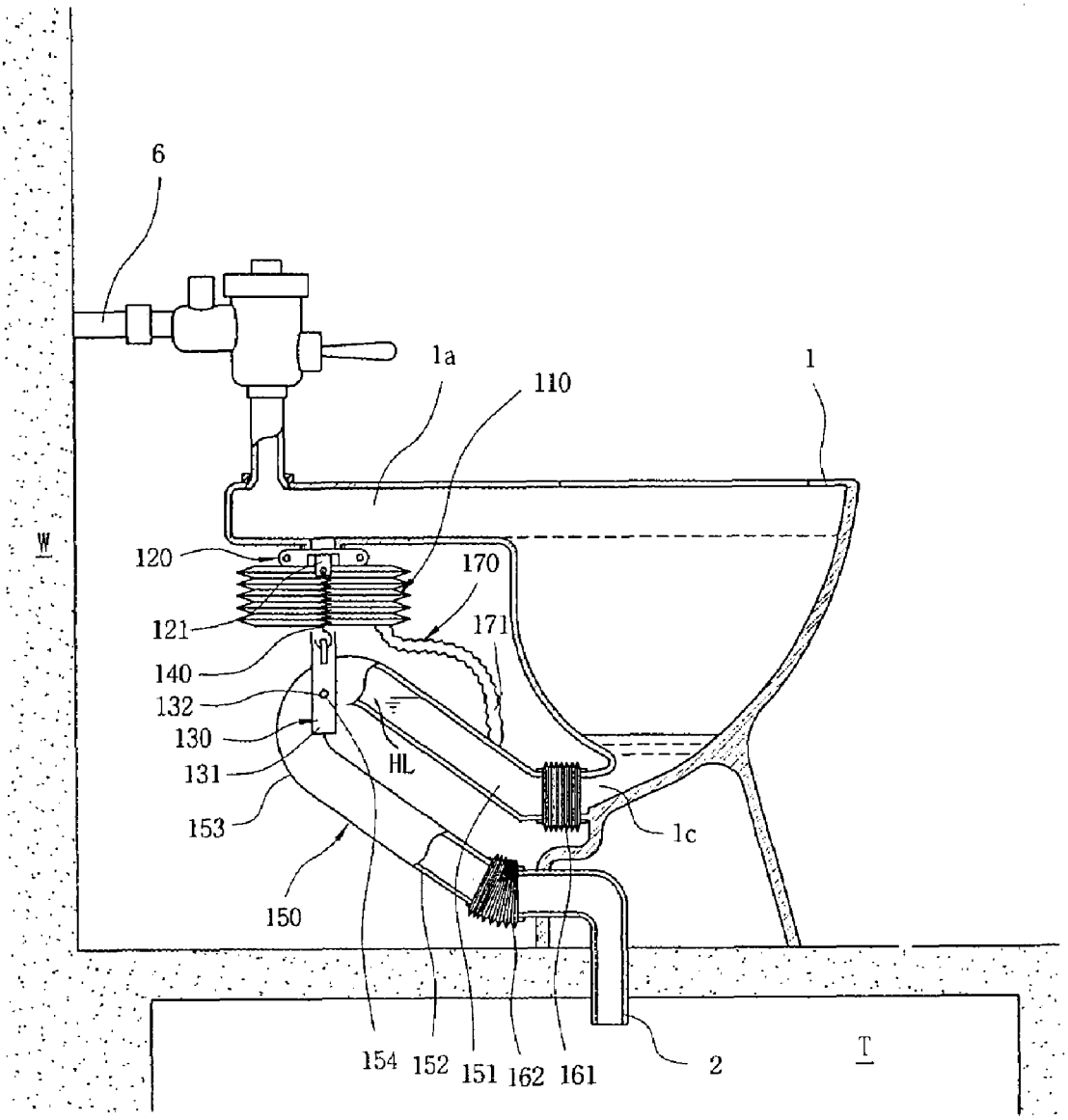
FIG. 4 is a view showing a state where the apparatus for operating the variable siphon tube according to the present invention is installed to a flush valve operated toilet.
Figure 5:
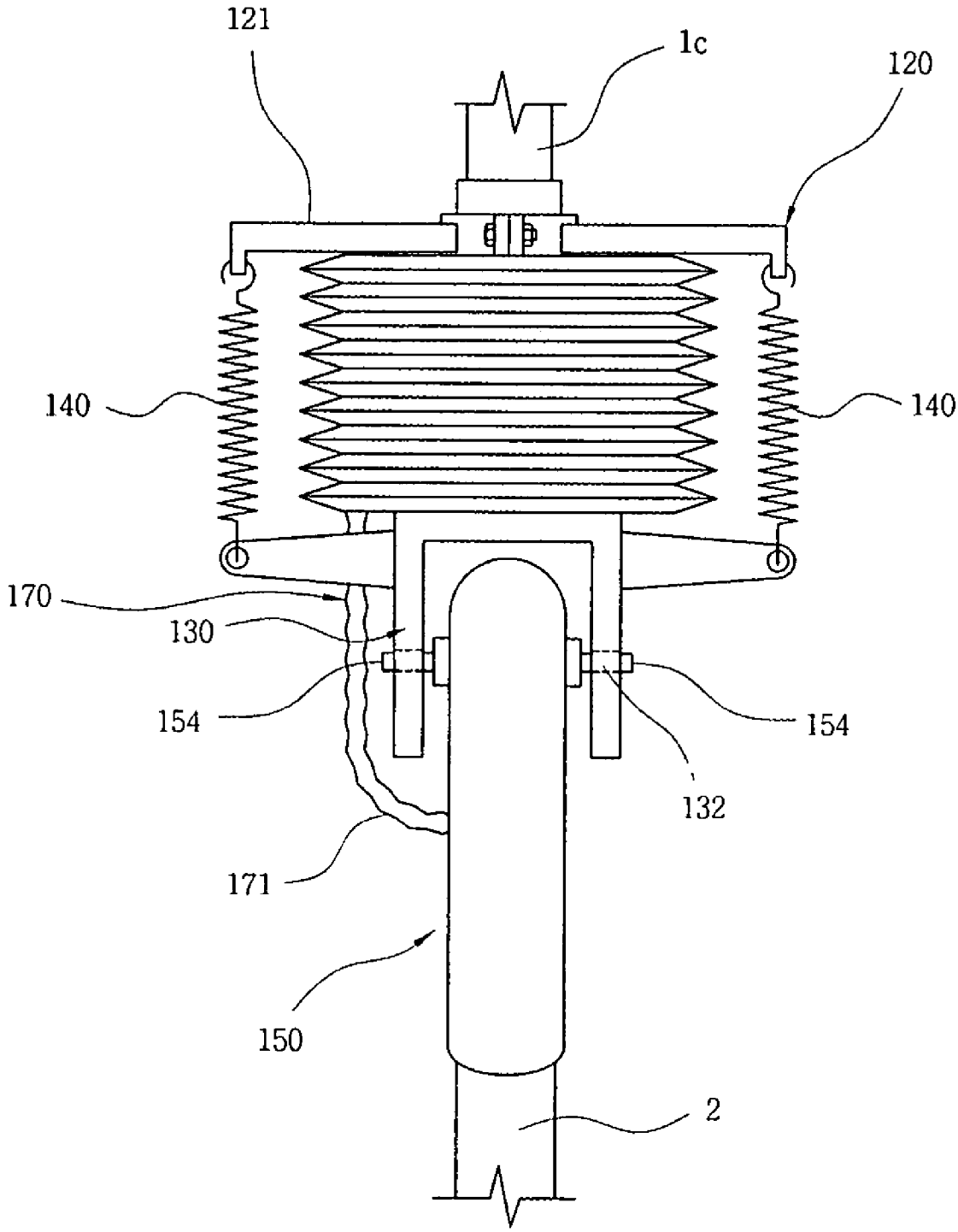
FIG. 5 is a view of the apparatus for operating the variable siphon tube according to the present invention as viewed from a direction of A in FIG. 3.

It is assumed that an apparatus for operating a variable siphon tube according to the present invention can be applied commonly to a gravity tank toilet in which water is stored in a water tank 5 and then discharged if necessary as shown in FIG. 3 and a flush valve operated toilet in which water is supplied from a water supply pipe (water service pipe) directly to a water supply passage of a toilet bowl as shown in FIG. 4.

The apparatus 100 for operating the variable siphon tube, which may be applied to the gravity tank toilet or flush valve operated toilet, comprises a pressing tube 110 in the form of a bellows tube which installed at a rear side of a toilet bowl 1 to communicate with a water supply passage 1*a*. Since the pressing tube 110 is in fluid communication with the water supply passage 1*a*, a portion of water is introduced into the pressing tube when the water supply passage is supplied with water.

An upper end of the pressing tube 110 is tightly coupled with a connection neck of the water supply passage 1*a* by means of a tightening ring 120. The tightening ring 120 is an injection-molded product obtained by combining a pair of semicircular half rings with each other using screws. A first hook 121 for hooking an upper portion of the return spring 140 to be explained later is integrally formed on one side of each of the half springs.

A bracket 130 is coupled on a bottom surface of the pressing tube 110. The bracket 130 is formed with second hooks 131 at opposite sides thereof and each of fitting holes 132 is also formed at a lower end of the bracket 130.

Upper end lower ends of the return spring 140 are connected to the first and second hooks 121 and 131, respectively. The return spring 140 provides an elastic force for upwardly pulling the bracket 130 and satisfies the following mechanical relationship with the pressing tube 110. That is, the return spring should be fully stretched by means of the total weight of the pressing tube and water when the pressing tube 110 is full of the water, whereas the return spring should have an elastic restoring force for raising the pressing tube 110, the bracket 130 and a variable siphon tube 150 to be explained later when there is no water in the pressing tube 110.

The variable siphon tube 150 is hinged to the bracket 130. The variable siphon tube 150 is a U-shaped plastic molded product which is formed with an inlet and outlet 151 and 152 at upper and lower positions on a side thereof, respectively, and with a bend 153 at the other side thereof. Hinge shafts 154 that are pivotally connected to the fitting holes 132 are also formed at lateral sides of the bend 153.

At this time, the inlet 151 is connected to a discharge port 1*c* of the toilet bowl 1 via a bellows tube 161, whereas the outlet 162 is connected to a waste discharge tube 2 through a bellows tube 161. The bellows tubes 161 and 162 serve to allow the variable siphon tube 150 to move slightly when the variable siphon tube is raised or lowered. In particular, the lower bellows tube 162 is preferably made of an elastic material such that the variable siphon tube 150 cannot rotate but move along a vertical direction when it is raised or lowered.

Further, an end of a vinyl tube 163 is connected to each of the bellows tubes 161 and 162 at its interior and the other end of the vinyl tube 163 is not connected to the tubes. Thus, the vinyl tube 163 serves to prevent toilet wastes from adhering and sticking to the inner surfaces of the bellows tubes 161 and 162 when the toilet wastes are discharged.

Finally, the pressing tube 110 and the variable siphon tube 150 are connected with each other through a connection tube 170. This connection tube is constructed in the form of a bellows tube because its length need be changed due to the operation of the pressing tube 110 and the variable siphon tube 150. Further, an upper end of the connection tube is connected to communicate with the bottom of the pressing tube 110 and a lower end thereof is connected to communicate with the variable siphon tube 150, so that the water in the pressing tube 110 can be discharged into the toilet bowl 1.

At this time, the lower end 171 of the connection tube 170 should be positioned below the highest water level HL in the variable siphon tube 150. The reason is that the water remaining in the variable siphon tube 150 allows an offensive odor to be introduced from a toilet waste storage tank T into a room.

The operation of the present invention so configured will be described with reference to FIGS. 6 and 7.

Figure 6:
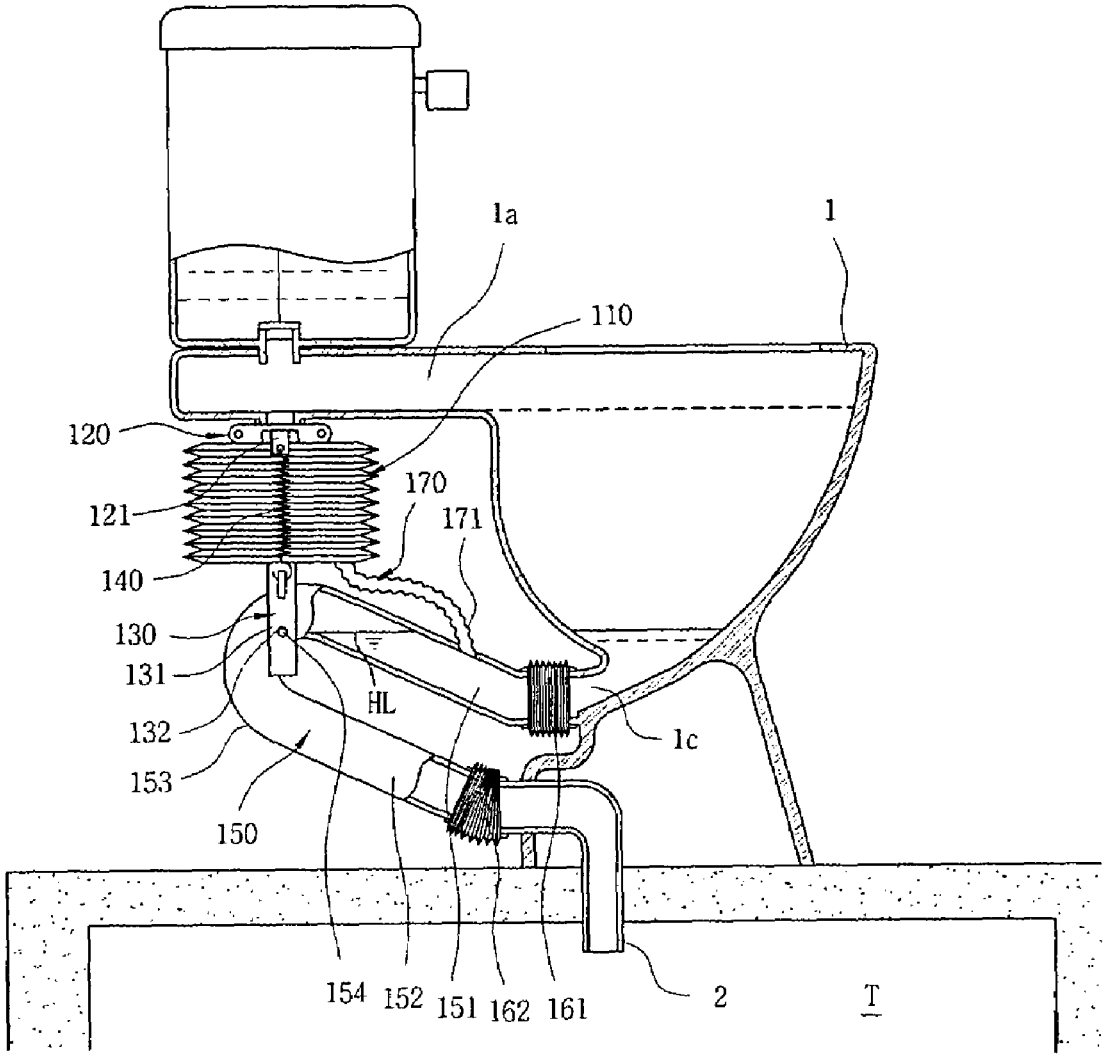
FIG. 6 is a sectional view of an apparatus for operating the variable siphon tube according to the present invention, before it is operated.
Figure 7:
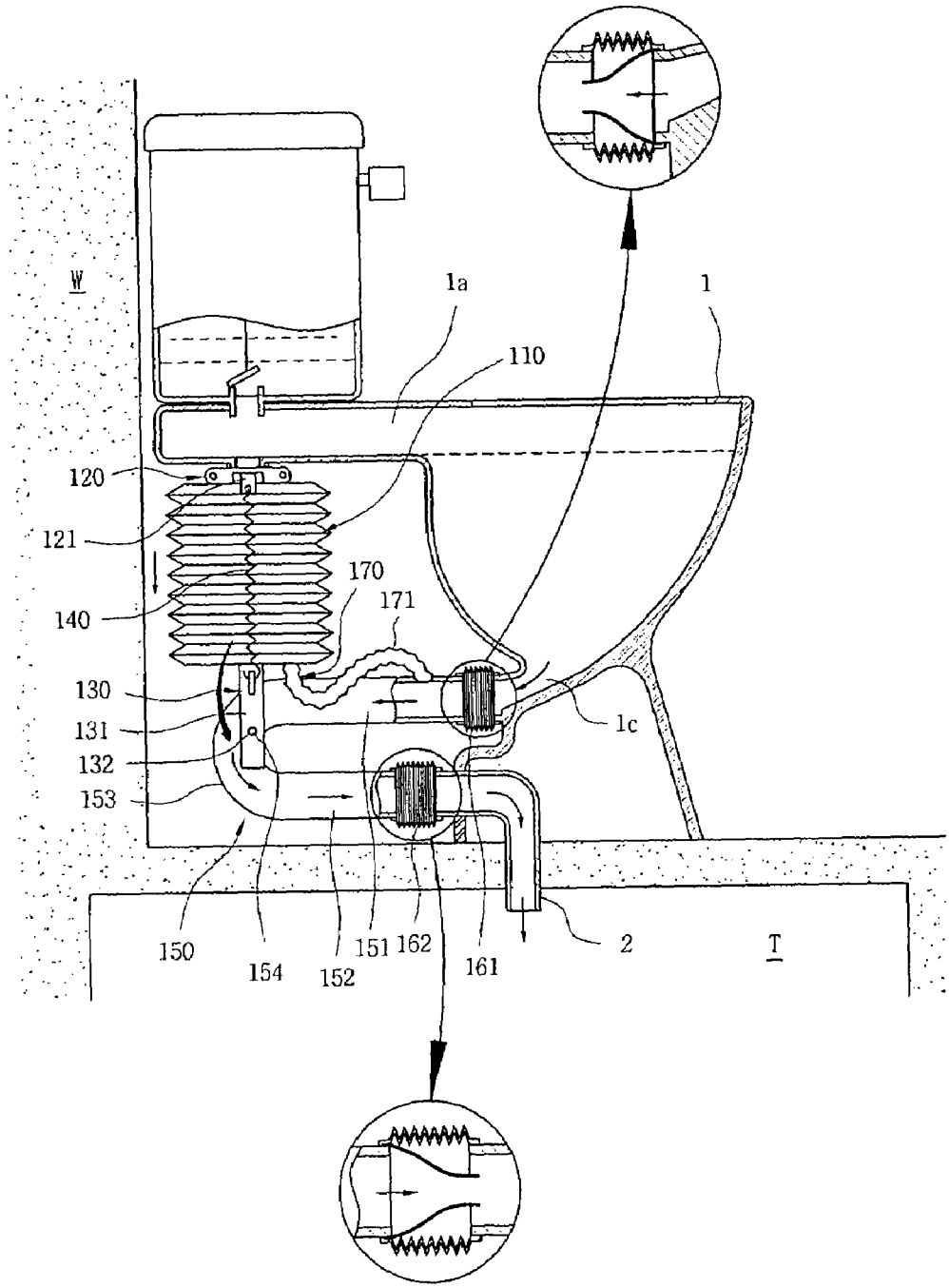
FIG. 7 is a sectional view of the apparatus for operating the variable siphon tube according to the present invention, after it is operated.

Before use, as shown in FIG. 6, the toilet is in a state where the pressing tube 110 is compressed by means of the elastic force of the return spring 140, the bracket 130 is raised and the rear bend 153 of the variable siphon tube 150 is located at an upward raised position.

In addition, water is filled in an upper section of the variable siphon tube 150 at the same level as the toilet bowl 1.

When water is supplied from a water tank 5 or water supply pipe 6, a portion of the water is supplied into the toilet bowl 1 through the water supply passage 1*a* while the other portion of the water is also supplied into the pressing tube 110.

As the pressing tube 110 is filled with the water, it is stretched downward due to the weight of water filled therein. At the same time, the bracket 130 associated with the pressing tube 110 and the bend 153 of the variable siphon tube 150 hinged to the bracket 130 are also moved downwardly.

In particular, as the bend 153 of the variable siphon tube 150 is lowered, the inlet and outlet 151 and 152 of the variable siphon tube 150 are in a state where they are positioned in a slightly downward straight way. Therefore, since the toilet wastes can be spontaneously discharged, the wastes can be completely washed off and the amount of flushing water can be minimized. Furthermore, the noise generated during the excretion discharge can also be remarkably reduced.

On the other hand, when the supply of water into the water supply passage 1*a* is stopped, the water filled in the pressing tube 110 is supplied little by little into the toilet bowl 1 through the connection tube 170 via the variable siphon tube 150 and filled in the toilet bowl 1 as remaining water.

Since the water in the pressing tube 110 gradually drains away as mentioned above, the weight of the pressing tube is reduced. Therefore, the pressing tube is restored to its original state due to the restoring force of the return spring.

The invention claimed is:

1. An apparatus for operating a variable siphon tube for use in a gravity tank toilet including a toilet bowl and a water tank, comprising:

a pressing tube in the form of a bellows tube, the pressing tube being installed at a rear side of the bowl and communicated in fluid with a water supply passage;

a tightening ring consisting of two semicircular rings combined with each other for tightly coupling the top of the pressing tube with a connection neck of the water supply passage, said tightening ring including first hooks provided at both sides thereof;

a bracket coupled with a bottom surface of the pressing tube, said bracket including second hooks provided at both sides thereof and fitting holes formed at a lower end portion of the second hooks;

return springs, each of which being connected to the first hook by one end thereof and the second hook by the opposite end;

a variable siphon tube including an inlet formed at one end, an outlet formed at the opposite end and a bend formed at a mid portion thereof, said inlet having a first bellows tube connected to a discharge port of the bowl, said outlet having a second bellows tube connected to a toilet waste discharge tube, said bend being formed with hinge shafts at both lateral sides thereof, said hinge shafts being fitted into the fitting holes, respectively; and a connection tube for connecting the pressing tube and the variable siphon tube.

2. The apparatus as claimed in claim 1, wherein an inlet end of the connection tube is communicated in fluid with a bottom portion of the pressing tube and an outlet end of the connection tube is positioned below a highest water level in the variable siphon tube before use.

3. The apparatus as claimed in claim 1, further comprising a vinyl tube installed within each of the bellows tubes.

* * * * *